US005270674A

United States Patent [19]

Nakanishi et al.

[11] Patent Number: 5,270,674

[45] Date of Patent: Dec. 14, 1993

[54] ELECTROMAGNETIC RELAY

[75] Inventors: Yoichi Nakanishi; Ryuichi Sato, both of Kyoto; Hiroyuki Sagawa, Shiga; Masayuki Noda, Osaka; Mitsuhiro Kawai, Osaka; Kazumi Sako, Osaka, all of Japan

[73] Assignee: Omron Corporation, Kyoto, Japan

[21] Appl. No.: 794,194

[22] Filed: Nov. 19, 1991

[30] Foreign Application Priority Data

Nov. 21, 1990 [JP] Japan ..... 2-319922
Nov. 21, 1990 [JP] Japan ..... 2-319923
Nov. 30, 1990 [JP] Japan ..... 2-129398[U]

[51] Int. Cl.[5] ..... H01H 51/22

[52] U.S. Cl. ..... 335/78; 335/80; 335/85

[58] Field of Search ..... 335/78-86, 335/124, 128, 131, 202

[56] References Cited

U.S. PATENT DOCUMENTS 4,346,359 8/1982 Pirner et al. ..... 335/128
5,015,978 5/1991 Yokoo et al. ..... 335/78
5,084,688 1/1992 Martino ..... 335/128
5,095,294 3/1990 Chikira et al. ..... 335/78
5,117,209 5/1992 Sato ..... 335/80
5,126,709 6/1992 Tanaka et al. ..... 335/80

FOREIGN PATENT DOCUMENTS 0118715 9/1984 European Pat. Off. .
0355817 2/1990 European Pat. Off. .
0437209 7/1991 European Pat. Off. .
802688 3/1989 Fed. Rep. of Germany .
1-274332 3/1989 Japan .

OTHER PUBLICATIONS

Patent Abstracts of Japan, vol. 14, No. 182.

*Primary Examiner*—Lincoln Donovan
*Attorney, Agent, or Firm*—Fish & Richardson

[57] ABSTRACT

An electromagnetic relay of the present invention has a large dielectric strength between a coil and each contact because of an insulative member interposed therebetween. Even if the straight distance between the coil and each contact is small, it is possible to obtain a sufficient dielectric strength without an extra process. Moreover, since a leg part of the coil terminal is coated with an insulative resin, the dielectric strength between the coil terminal and a movable iron element or a movable contact piece is enhanced. An insertion window formed in an insulating plate of the coil helps to insert a thickness gauge with high positioning accuracy.

4 Claims, 6 Drawing Sheets

ELECTROMAGNETIC RELAY

BACKGROUND OF THE INVENTION

1. Field of the Invention

The present invention relates to an electromagnetic relay.

2. Description of Relevant Art

An example of a conventional electromagnetic relay is shown in FIG. 9.

In the electromagnetic relay of FIG. 9, a coil block 5 is accommodated in a housing part 2 of a box-like base 1. A terminal 4 exposed from an upper surface of the base 1 is welded to a terminal 8 protruding at a hook part 7 formed at each end of a spool 6 of the coil block 5. A movable block 12 is attached to a permanent magnet 9 mounted at the center of the coil block 5 in a swaying fashion. A casing 17 is fitted into the base 1 after all the components of the electromagnetic relay are arranged as above.

The electromagnetic relay in the aforementioned structure operates in the following manner. That is, when a voltage is impressed to a coil 10 of the coil block 5, the opposite ends of a movable iron element 13 of the movable block 12 are alternately attracted to the ends of a yoke 11 confronting thereto. As a consequence, a movable contact 15 at each end of a movable contact piece 14 which is supported by a supporting part 16 at either side of the movable iron element 13 is brought into contact with or detached from a fixed contact 3 exposed at an upper surface of the side wall of the base 1.

According to the above-described structure of the electromagnetic relay, it is difficult to keep a sufficient distance between each of the contacts 3, 15 and the coil 10 as it is a recent trend to make the relay compact in size. Therefore, the dielectric strength therebetween has been undesirably lowered.

As a solution to the above problem, the coil part has been coated in some cases with an insulative resin after the coil block 5 was assembled. However, this method takes a deal of cost and labor.

SUMMARY OF THE INVENTION

The object of the present invention is therefore to provide an electromagnetic relay featuring a large dielectric strength between a coil and a contact at low cost.

In order to achieve the aforementioned object, an electromagnetic relay is provided according to the present invention, which comprises a coil block including an iron core having a coil wound therearound via a spool, and a movable block supported in a manner to be able to turn either above or lower the coil block and having movable contact pieces integrally arranged with a movable iron element, so that the contacts are opened/closed by the movable contact pieces of the movable block when the movable block is turned in accordance with the magnetization or demagnetization of the coil block, wherein an insulative member is interposed between the coil block and the movable block. The spatial distance and surface distance between the coil and each contact can be elongated by the insulative member.

According to a further aspect of the present invention, an electromagnetic relay is provided which comprises a coil block wherein a leg part of a coil terminal protruding from a brim of a spool having a coil wound therearound is extended downwards, a movable iron element driven in accordance with the magnetization or demagnetization of the coil block and, movable contact pieces driven and supported below the coil block along with the movable iron element thereby to open or close the contacts, characterized in that the central part of the leg part of the coil terminal in the vicinity of the movable iron element and movable contact piece is coated with an insulative resin. The rigidity of the leg part is eventually improved and moreover, the insulating property between the movable iron element or movable contact piece and the leg part of the coil terminal is enhanced.

According to a still- further aspect of the present invention, an electromagnetic relay is provided which comprises a coil block including an iron core having a coil wound therearound via a spool, a movable block having movable contact pieces integrally arranged with a movable iron element and driven below the coil block, and an insulating plate provided at a leg part of a coil terminal integrally formed with a brim of the coil block and extending downwards, so that the contacts are opened or closed when an end of the movable iron element is brought into or out of contact with an end of the iron core in accordance with the magnetization or demagnetization of the coil, wherein a gauge insertion window is formed to measure the contact follow at a part of the insulating plate confronting the central part of the surface where the movable iron element butts against the iron core. When a thickness gauge is to be inserted into the gauge insertion window, it can be correctly inserted into the central part of the butting surface between the movable iron element and iron core since the position of the thickness gauge is controlled by the insertion window.

BRIEF DESCRIPTION OF THE DRAWINGS

These and other objects and features of the present invention will become clear from the following description taken in conjunction with a preferred embodiment thereof with reference to the accompanying drawings throughout which like parts are designated by like reference numerals, and in which.

DETAILED DESCRIPTION OF PREFERRED EMBODIMENTS

Figure 1:
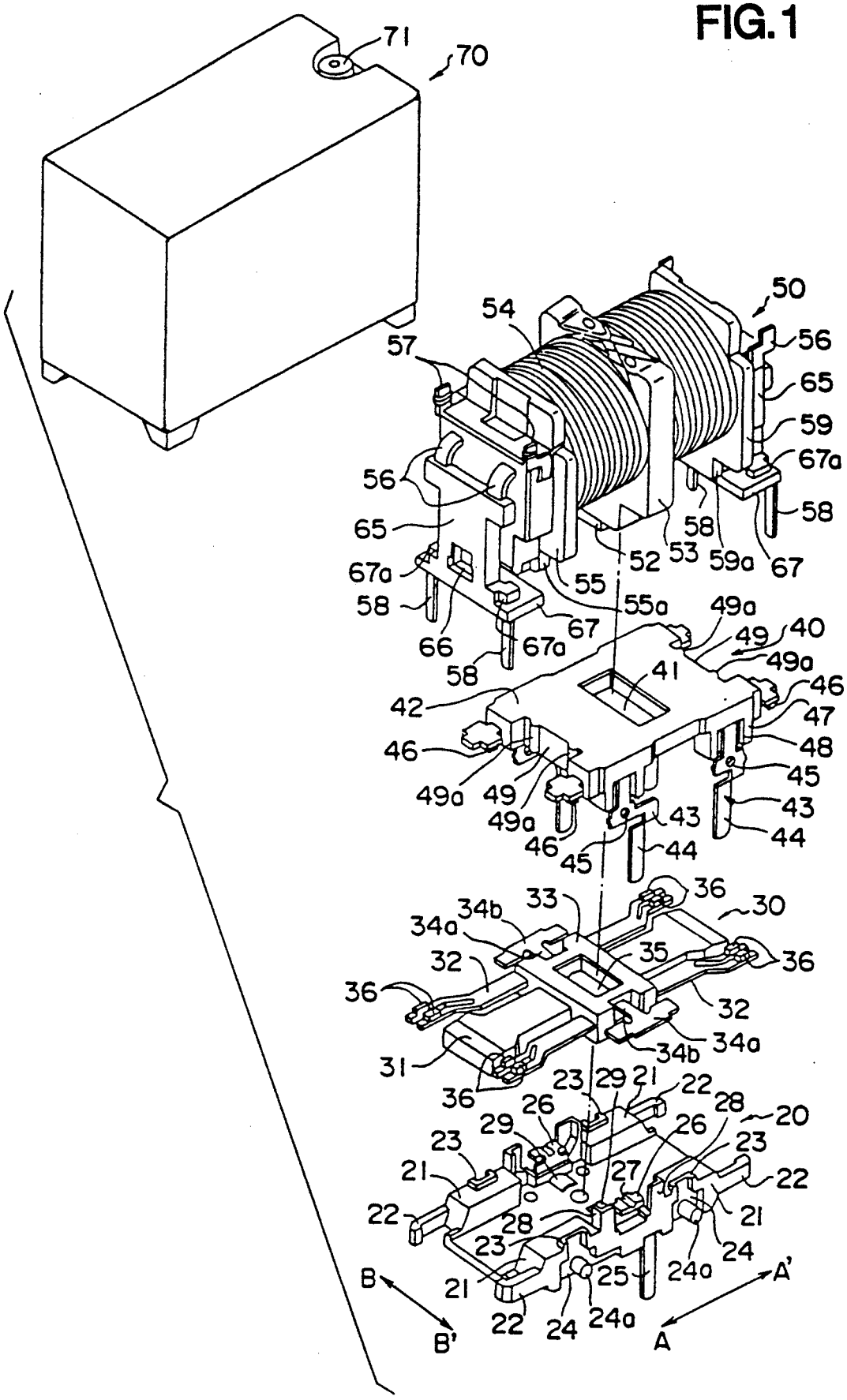
FIG. 1 is an exploded perspective view of an electromagnetic relay according to the present invention.
Figure 2:
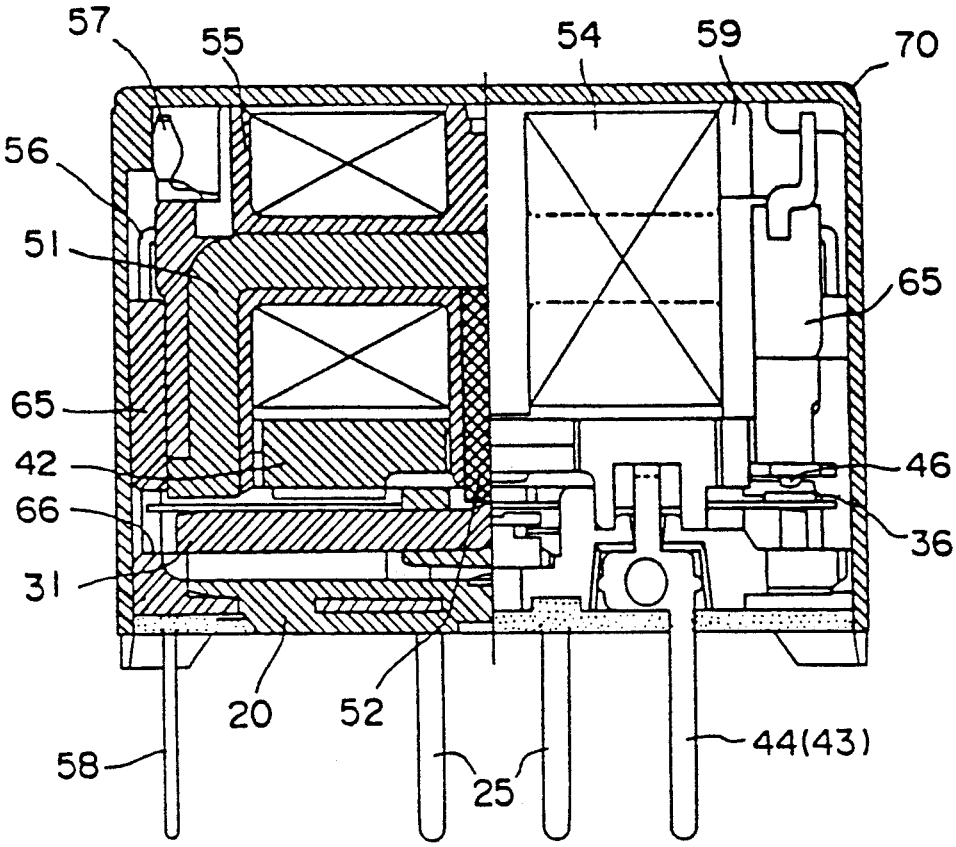
FIG. 2 is a front sectional view of FIG. 1.
Figure 3:
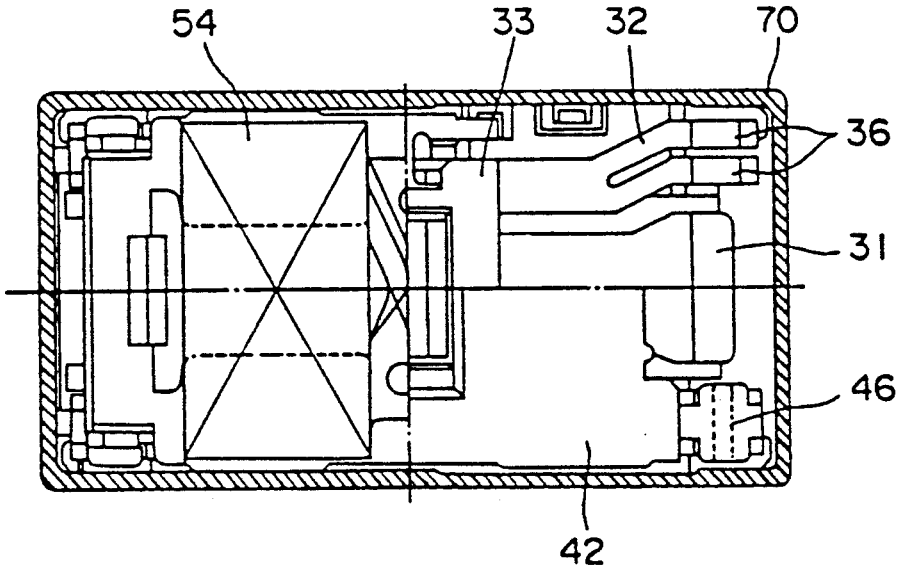
FIG. 3 is a top sectional view of FIG. 1.
Figure 4:
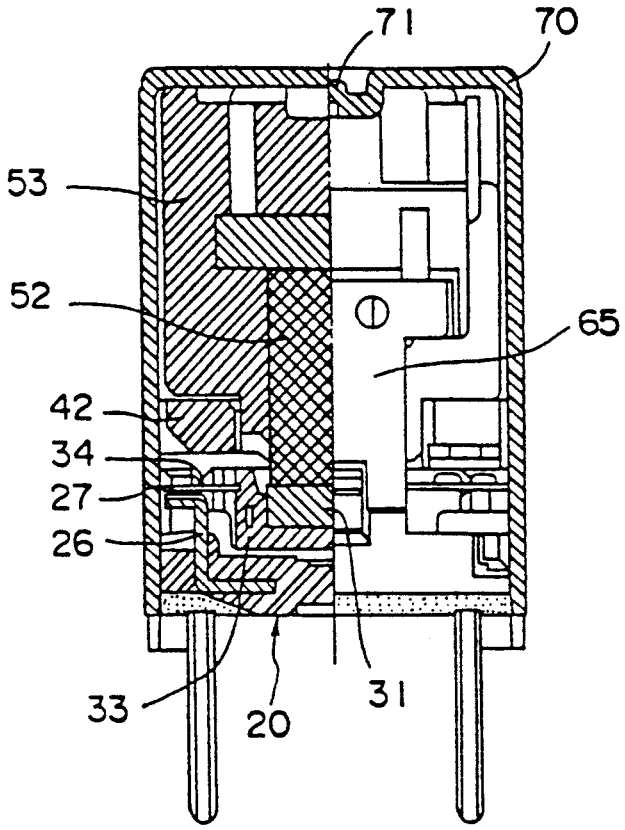
FIG. 4 is a side sectional view of FIG. 1.
Figure 5:
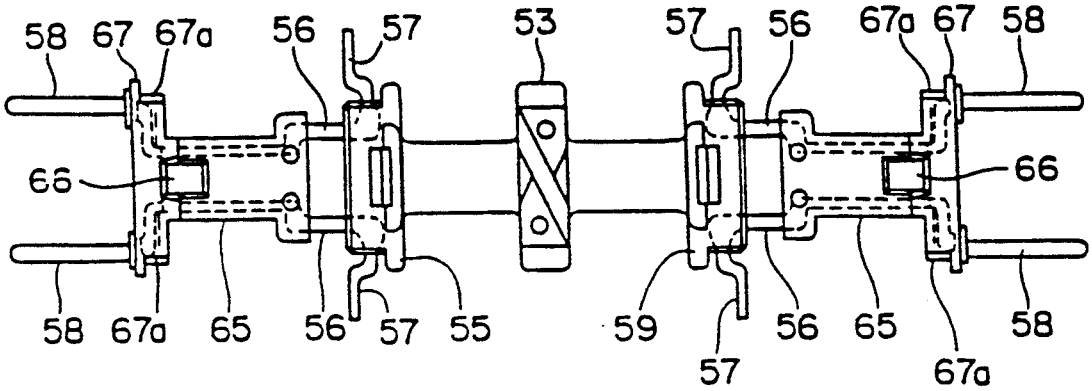
FIG. 5 is a plan view of a coil block.
Figure 6:
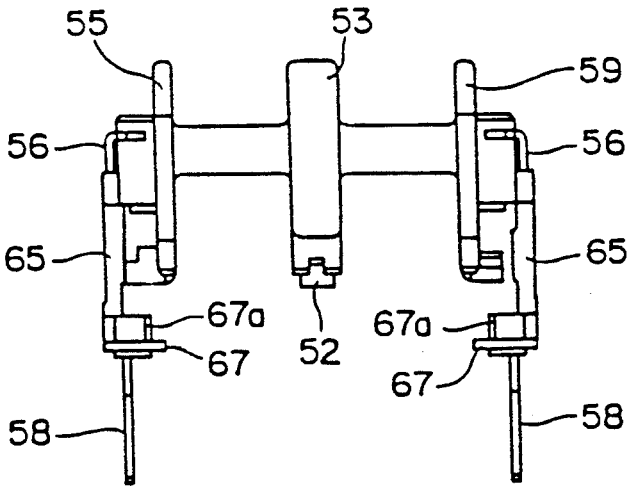
FIG. 6 is a front view of FIG. 5.

A preferred embodiment of the present invention will be depicted hereinbelow with reference to FIGS. 1 to 7.

An electromagnetic relay of the present invention generally consists of a first base block 20, a movable block 30, a second base block 40 as an insulating member, a coil block 50 and a casing 70.

The first base block 20 is a generally rectangular plate-like body having a pedestal 21 at each corner of the plate. A hook 22 extends from each pedestal 21 in the direction indicated by the line A to A'. A grooved part 24 with a first guide 23 is formed at the side face of each pedestal 21. A protrusion 24a projects from the grooved part 24.

A common terminal 25 is insertion-molded at the central part of an edge at each longer side of the first base block 20. The common terminal 25 has a welding part 26 projecting from the upper surface of the first base block 20. A generally T-shaped upper part of the welding part 26 is bent. There is a grooved part 27 formed in the direction indicated by the line B to B' at the central part on the upper surface of the welding part 26. A second guide part 28 projects on either side of the welding part 26. In the middle of the common terminals 25, 25 is provided a pair of projecting parts 29, 29 to prevent the deformation of a connecting part 34 when an up-and-down impact is impressed to the movable block 30 which will be described below.

The movable contact pieces 32 of the movable block 30 are integrally molded at both lateral sides of a movable iron element 31 by a supporting part 33 made of resin. The movable iron element 31 is generally I-shape with a small width except for the opposite ends thereof. Each movable contact piece 32 is made of a conductive thin plate and bent along the side face of the movable iron element 31, having movable contacts 36 of a so-called twin structure at either end thereof. The aforementioned connecting part 34 is generally T-shape and extends sideways from the central part of the movable contact pieces 32.

A recess 35 is formed at the central part of the upper surface of the supporting part 33, so that the central part of the upper surface of the movable iron element 31 is exposed.

In order to form the second base block 40, four fixed contact pieces 43 are insertion-molded at each corner of a rectangular plate-like body 42 made of insulating resin. An elongated hole 41 is opened in the direction indicated by the line B to B' at the central part of the second base block 40, and an engaging groove 49 is formed at the central part of each shorter side of the second base block 40. A pair of protruding parts 49a, 49a protrude in the direction indicated by the line A to A' in each engaging groove 49. A leg 44 of the fixed contact piece 43 is projected downwards within an engaging recess 48 of a base part 77 at the lower surface of each corner of the plate-like body 42. A through-hole 45 is formed in the upper part of the leg 44.

An end of the fixed contact piece 43 protrudes in the direction indicated by the line A to A' from the end face of the shorter side of the plate-like body 42, on the lower surface of which is formed a fixed contact 46.

In the coil block 50, one end of a generally U-shaped iron core 51 is bent outside and a permanent magnet 52 is brought to butt against the central part of the iron core 51. The iron core and permanent magnet are then formed into one body by a spool 53 made of insulating resin and wound with a coil 54 (referring to FIG. 2). A coil terminal 56 is insertion-molded at each of opposite upper ends of a brim 55 or 59 at the side edge of the spool 53. The brims 55 and 59 have stepped parts 55a and 59a, respectively. An upper end of the coil terminal 56 works as a tie part 57 for a coil leader which projects upwards from the brim 55 or 59.

In the meantime, a side plate 65 made of an insulating material is insertion-molded in the middle of the legs 58, 58 of the pair of the coil terminals 56, 56 simultaneously when the spool 53 is insertion-molded. Therefore, the legs 58, 58 are integrally coupled with each other. This side plate 65 has a window 66 for insertion of a thickness gauge. The window 66 is formed at such a position as to confront the central part of the surface where the movable iron element 31 butts against the iron core 51. The inner side faces of the insertion window 66 are able to guide the side edges of a thickness gauge to be inserted (not shown), so that the thickness gauge is positioned at the central part of the butting surface correctly. Moreover, the thickness gauge is prevented from slipping out of the insertion window 66 even when the user loses his hold of the gauge because of the upper and lower inner faces of the insertion window 66. A wide section 67 spreads at the outer side end of each side plate 65, with engaging parts 67a, 67a formed at the root thereof.

Since the adjacent coil terminals 56, 56 are integrally molded by the side plate 65 as described above, the distance between the legs 58 and 58 can be set correctly and at the same time, the rigidity of the legs 58 can be increased. It is to be noted here that the leg 58 of the coil terminal 56 is extended in the arrow direction A or A' before the coil block 50 is mounted to the first base block 20, and bent as indicated in FIG. 1 when the block 50 is assembled with the first base block 20. The coil terminals 56 provided in the rim 59 are dummies without the coil 54 wound therearound.

The casing 70 is in the form of a box, the lower face of which is open. A gas vent 71 is formed at the central part of a shorter side on the upper surface of the casing 70.

The magnetic relay is assembled into the above-described structure in a manner as will be depicted below.

In the first place, the connecting part 34 of the movable block 30 is brought to butt against the welding parts 26 of the common terminals 25 while being guided by the second guide parts 28, so that the moyable block 30 is mounted to the first base block 20. The movable block 30 is supported at a fulcrum of the connecting part 34 when the connecting part 34 is welded to the welding parts 26.

Secondly, the second base block 40 is assembled with the first base block 20. During the process, each leg 44 of the fixed contact piece 43 is pressed into contact with the side face of the first base block 20 and accordingly the leg 44 is expanded wide and deformed in the arrow direction indicated by the line B to B'. Then, the through-hole 45 of the leg 44 is fitted into the corresponding protrusion 24a of the first base block 20. Thereafter, the leg 44 is returned to the original shape At this time, since the portion of the leg 44 bent in a horizontal direction butts against the lower face of the first base block 20, the second base block 40 is temporarily fixed to the first base block 20.

Moreover, the second base block 40 is positioned since each first guide 23 of the first base block 20 is fitted in a gap between the leg 44 and engaging recess 48 formed behind the leg 44. The protrusion 24a is thermally caulked afterwards. As a consequence, the second base block 40 is fixed to the first base block 20.

As described hereinabove, the position of the connecting part 34 of the movable block 30 is regulated by the second guide parts 28 of the first base block 20, and the position of the engaging recesses 48 of the second base block 40 is regulated by the first guides 23 of the first base block 20. Therefore, the positional relation between the movable contact 36 and fixed contact 46 can be set correctly.

Subsequently, the coil block 50 is combined. Each leg 58 of the coil terminal 56 remains in the extended state in the direction indicated by the line A to A' during the assembly.

The stepped parts 55*a*, 59*a* of the brims 55, 59 of the spool 53 are fitted into the engaging grooves 49 of the second base block 40, whereby the spool 53 is positioned to the second base block 40. Then, the legs 58 are bent and the engaging parts 67*a* of each side plate 65 are engaged with the hooks 22 of the first base block 20 Thus, the coil block 50 is fixed to the first base block 20.

In the above state, the side faces of the permanent magnet 52 are guided by the recess 35 of the movable block 30 via the elongated hole 41 of the second base block 40, and the lower end face of the permanent magnet 52 butts against the movable iron element 31 of the movable block 30. Furthermore, the coil 54 is separated from the contacts 36, 46 by the flat plate 42 of the second base block 40 and brims 55, 59 of the coil block 50. Accordingly, sufficient insulation is secured in spite of a short straight distance between the coil 54 and contacts 36, 46.

After the above procedure, the contact follow will be measured with use of a non-magnetic thickness gauge inserted through the insertion window 66 of the side plate 65.

The horizontal position of the thickness gauge is controlled by the insertion window 66. Specifically, since the side faces of the thickness gauge butt against the inner side faces of the insertion window 66, a front end of the thickness gauge is possible to correctly reach the central part of a free end of the movable iron element 31. Even if the user loses his hold of the gauge in this state, the thickness gauge is stopped by the upper and lower inner faces of the insertion window 66, thereby being prevented from falling off the side plate 65.

In the case where a desired contact follow cannot be obtained, each hook 22 of the first base block 20 is bent to be released from the engagement with the engaging part 67*a* of the side plate 65. And, the coil block 50 is detached and a horizontal end of each fixed contact piece 43 where the fixed contact 46 is formed is deflected for adjustment.

Finally, the ceiling of the casing 70 is brought to butt against the upper surfaces of the brims 55, 59 of the spool 53 to be fitted with the first base block 20. The fitting part is sealed by a sealing material. After the internal gas is discharged through the gas vent 71, the assembled body is thermally sealed. The assembling process is thus completed.

In the non-magnetized state of the electromagnetic relay without a voltage impressed to the coil 54, one end of the iron core 51 of the coil block 50 is bent outward and the area becomes wider than the other parts, resulting in the imbalance of magnetism. Therefore, the movable iron element 31 is turned in one direction, and movable contacts 36 at one side of the movable iron element 31 are attracted to the confronting fixed contacts 46.

If the coil block 50 is magnetized by the impression of a voltage to the coil 54 from the above-described state, the movable iron element 31 is turned, allowing the movable contacts 36 at the other side of the movable iron element 31 to close the confronting fixed contacts 46. The former contacts 36, 46 are consequently opened. If the magnetization is removed, the movable iron element 31 is returned to the original position.

According to the electromagnetic relay of the present invention, the fixed contacts 46 are arranged above the movable contacts 36 and moreover, the turning center of the movable iron element 31 is set above the movable contact pieces 32. Such an arrangement as according to the present invention is more advantageous in the following points in comparison with the case where fixed contacts 80 are provided below the movable contacts 36 as shown in FIG. 8.

Figure 8:
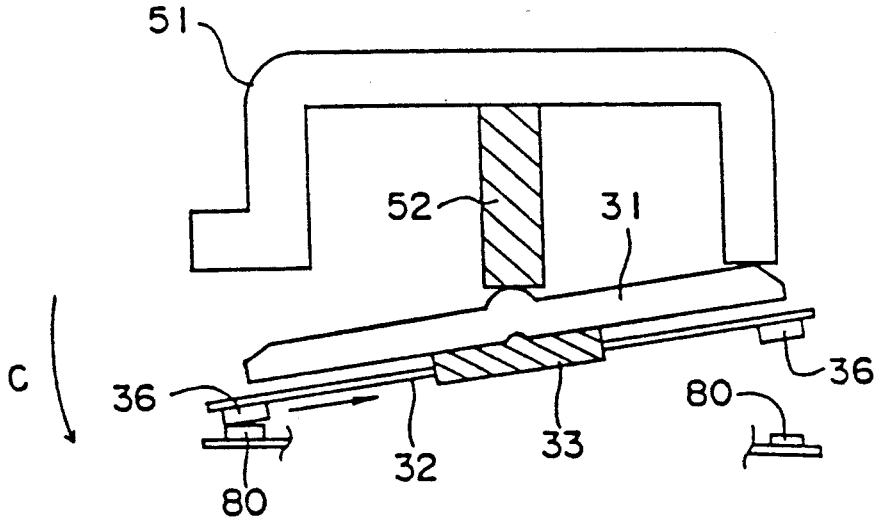
Figure 9:
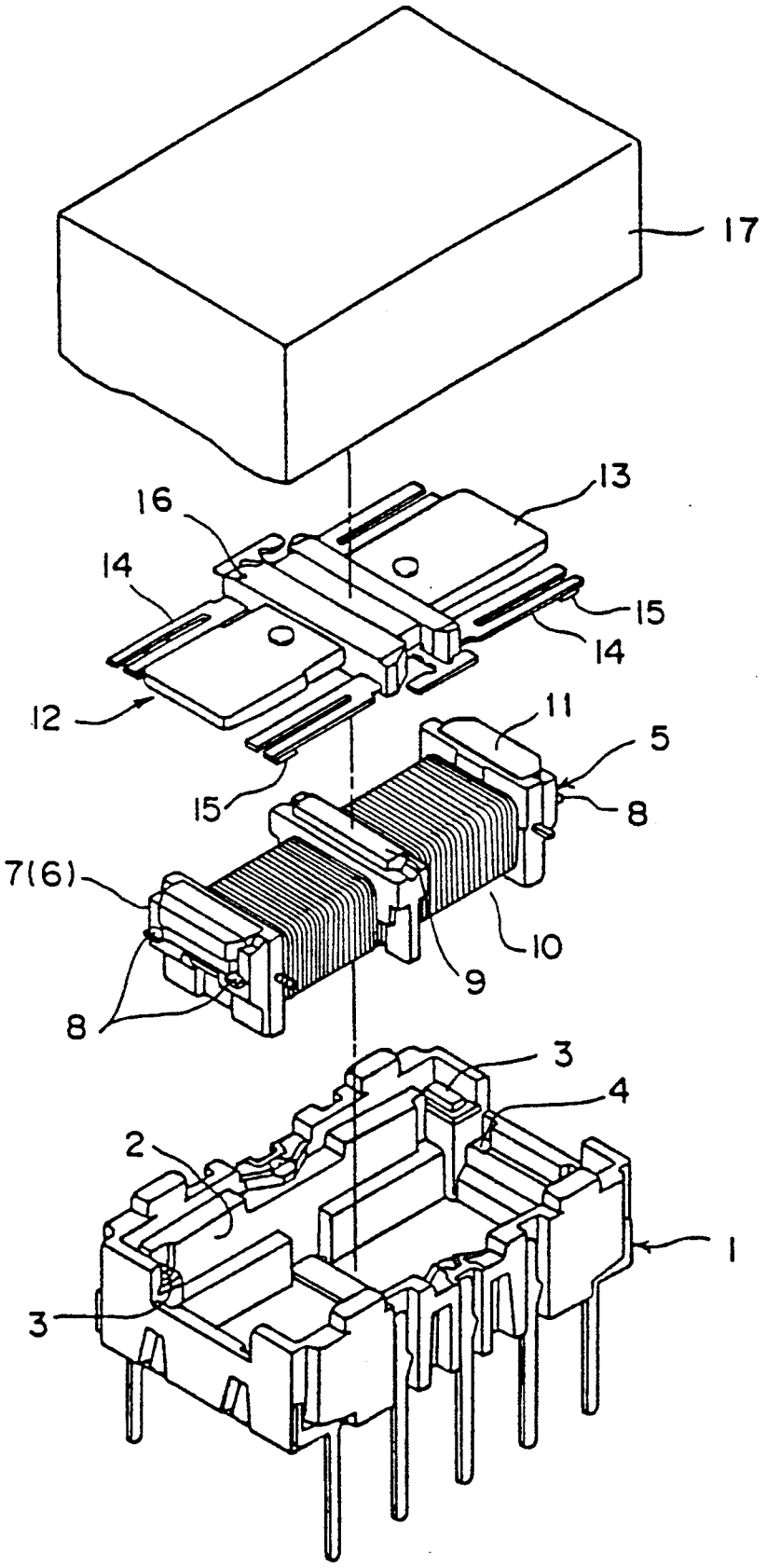
FIG. 9 is an exploded perspective view of a conventional electromagnetic relay.

More specifically, in FIG. 8, the movable contact piece 32 is slightly bent to obtain a predetermined contact pressure when the contacts are closed. Therefore, the movable contact piece 32 receives a force in a direction shown by an arrow at the welding time, with applying a moment in a direction shown by an arrow C to the movable iron element 31. Since this moment acts in a direction opposite to the direction in which the movable iron element 31 is separated from the iron core 51, the movable iron element 31 eventually becomes difficult to turn.

Figure 7:
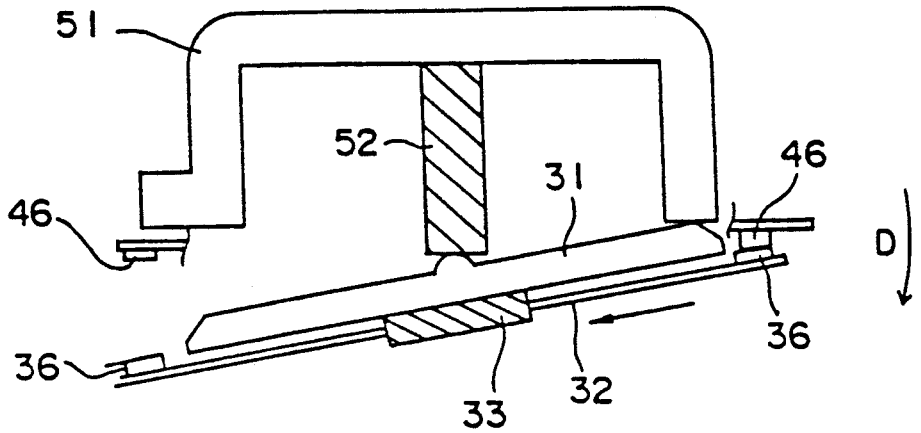
FIGS. 7 and 8 are views explanatory of the operation of a movable iron element when contacts are welded according to the present invention and a conventional example, respectively.

In contrast to the above, as indicated in FIG. 7, when the fixed contacts 46 are positioned above the movable contacts 36, the movable contact piece 32 is impressed with a force in a direction of an arrow, thereby causing a moment of a direction shown by an arrow D to the movable iron element 31. In other words, the moment is in the same direction as the turning direction of the movable iron element 31, whereby the contacts are easily separated from each other at the welding time.

In the present embodiment, the electromagnetic relay is of a self-recovery type, wherein the magnetic balance is arranged to be lost by the shape of the iron core 51 of the coil block 50. However, it may be possible to attach an insulative thin plate to an upper surface at one side of the movable iron element 31, or a self-retaining type of an electromagnetic relay may be possible.

Further, although the movable block 30 is turned below the coil block 50 in the foregoing embodiment, the movable block 30 may be turned above the coil block 50 and, in that case, the second base block 40 should be positioned above the coil block 50.

As is clear from the above description, in the electromagnetic relay of the present invention, since the coil is separated from each contact by the insulative member, it is possible to obtain a sufficient dielectric strength even though the straight distance between the coil and each contact is small.

As a result, it becomes unnecessary to coat the coil with an insulative resin or the like in an extra process, and the dielectric strength can be improved at low cost.

Further, since each leg of the coil terminal extending from the brim of the spool is coated with an insulative resin, the dielectric strength between the coil terminal and, movable iron element and movable contact piece is increased.

The increase of the strength of the coil terminal owing to the insulative resin makes it easy to insert the coil terminal into the base block, and therefore the assembling efficiency is improved.

Moreover, because of the gauge insertion window, the thickness gauge can be inserted with high positioning accuracy, thereby improving the reliability of the measured values.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. An electromagnetic relay comprising:

a coil block including an iron core having a coil wound therearound via a spool, said iron core being substantially U-shaped and having two ends;

a movable block supported in a manner to be able to move toward and away from said coil block, and having movable contact pieces arranged integrally with a movable iron element, so that contacts are closed or opened by said movable contact pieces of said movable block which is moved in response to the magnetization or demagnetization of said coil block, and an insulating member interposed between said coil block and said movable block, and wherein a portion of said insulating member is disposed between said ends of said iron core.

2. An electromagnetic relay as claimed in claim 1, wherein:

said coil block includes a leg of a coil terminal projecting from a brim of said spool which has a coil wound therearound, said leg extends downward;

said movable iron element moves in accordance with the magnetization or demagnetization of said coil block;

said movable contact pieces are driven together by said movable iron element to close or open said contacts; and a central part of the leg of said coil terminal in the vicinity of said movable iron element and said movable contact pieces is coated with an insulating resin.

3. An electromagnetic relay comprising:

a coil block including an iron core having a coil wound therearound via a spool, said coil block further comprising a leg part of a coil terminal, and a brim, said iron core being substantially U-shaped and having two ends, said leg part of said coil terminal extending downward and being integrally formed with said brim of said coil block;

a movable block having movable contact pieces integrally arranged with a movable iron element and supported in a manner to be able to move toward and away from said coil block, said movable block arranged such that an end of said movable iron element is brought into or out of contact with an end of said iron core in accordance with the magnetization or demagnetization of said coil block to open or close contacts;

an insulating plate interposed between said coil block and said movable block; and a gauge insertion window for inserting a thickness gauge, said gauge insertion window being located at a central part of an end surface of the said coil block adjacent to where said movable iron element abuts against said iron core.

4. An electromagnetic relay as claimed in claim 1, said insulating member further comprising a leg and a fixed contact integral therewith.

* * * * *